US005636404A

United States Patent [19]

Ribera

[11] Patent Number: 5,636,404

[45] Date of Patent: Jun. 10, 1997

[54] PORTABLE SHOE AND BOOT TIE AND CLEANER APPARATUS FOR VEHICLES

[76] Inventor: Gilbert J. Ribera, 1389 'B' St., Hayward, Calif. 94541

[21] Appl. No.: 368,905

[22] Filed: Jan. 5, 1995

[51] Int. Cl.[6] ..... A46B 15/00; A47L 23/00

[52] U.S. Cl. ..... 15/161; 15/237

[58] Field of Search ..... 15/237, 238, 241, 15/112, 215–217, 161, 239, 240

[56] References Cited

U.S. PATENT DOCUMENTS 3,740,072 6/1973 Veith ..... 15/237

5,137,240 8/1992 Van Meter ..... 248/293

*Primary Examiner*—Mark Spisich

[57] ABSTRACT

A portable shoe and boot tie and cleaner apparatus for securing to automobiles, trucks and the like. This apparatus includes a web belt which is secured by the closed hood of a vehicle, an independent collapsible foot support pivotally attaches at the top to a base which hooks securely to the belt, a foot support pivotally attached to the top of the base and a brace that is pivotally attached to the bottom of the foot support. There is also two separate cleaning and scraping attachments which slide into position over the top of the foot support.

3 Claims, 8 Drawing Sheets

PORTABLE SHOE AND BOOT TIE AND CLEANER APPARATUS FOR VEHICLES

BACKGROUND OF THE INVENTION

This invention relates to a portable shoe and boot tie foot support with cleaner and scraping attachments to be used at a motor vehicle to assist a person in tying, cleaning and/or scraping shoes and/or boots.

DESCRIPTION OF RELEVANT ART

Foot supports for tying shoes, supports for cleaning shoes and supports for foot warming have been known in the art. They provide a fixed platform that is permanently affixed to a wall or to an automobile with one specific purpose.

In U.S. Pat. No. 3,740,072 to Veith, a foot cleaner device is disclosed which is permanently fixed to the frame of an automobile for the purpose of cleaning shoes. U.S. Pat. No. 597,049 to Cornell, a foot rest is described that is used to support feet while they being warmed by a heater. U.S. Pat. No. 5,137,240 to Van Meter, discloses a collapsible shoe tie apparatus for mounting to a wall.

The relevant prior art describes foot supports which have one specific purpose: to tie, to clean or to warm. All the prior art is fixed in place: to a wall; to an automobile. The prior art is not portable and does not combine shoe and boot tying, cleaning and scraping.

OBJECTS OF THE INVENTION

The primary object of this invention is to provide a portable device, easily secured on a motor vehicle to assist a person while tying their shoes or boots.

Another object of this invention is to provide attachments to the portable device which will assist the person to clean and scrape dirt and ice from shoes or boots.

Still another object of this invention is to provide a device that can be easily secured and detached at a motor vehicle by closing and opening the trunk or motor hood.

Yet another object of this invention is to provide a foot support in order to prevent back strain while tying,cleaning or scraping shoes or boots in the outdoors.

Other objects of this invention are to provide a portable shoe and boot tie and cleaning apparatus for attachment to automotive vehicles which is simple in design, inexpensive to manufacture and rugged in construction, easy to use and efficient in operation.

SUMMARY OF THE INVENTION

According to the present invention, as embodied and broadly described herein, a portable shoe and boot tie and cleaner apparatus is used for supporting a person while tying and/or cleaning a shoe or boot. The portable shoe and boot tie and cleaning apparatus is attached by hooks to the web belt that has been secured in place by closing a trunk or front hood of a motor vehicle on it. The web belt has a cylinder attached at the top that can be trapped under the hood of a motor vehicle. The belt has pairs of holes(eyelets) cut at regular intervals to receive the hooks on the base. The belt hangs vertically toward the ground with the base hooked to the belt at a height convenient to the user. The base which has a protruding lip at the bottom, lies flat against the belt and is pivotally connected at its top to the top of the foot support. The foot support has grooves on each side so that the cleaning and the scraping attachments can be slidely mounted securely on top. The bottom of the foot support is pivotally attached to the bottom of the brace, which folds into the underside of the foot support and they both hang vertically against the base when not in use. When in use the foot support pivots out at the bottom away from the base with the brace swinging down and locking the whole apparatus in place by wedging against the lip at the bottom of the base.

The two attachments are flat, each with arms that protrude down and underneath so that they can be slid into a locked position on top of the foot support. One attachment has wire brush-like fibre imbedded on its top surface for cleaning grass or dirt off of shoes or boots. The second attachment has short metal spikes imbedded on its top surface for scraping ice and hardened mud off of shoes and boots.

BRIEF DESCRIPTION OF THE DRAWINGS

The accompanying drawings, which are incorporated in and constitute a part of the specification, illustrate preferred embodiments of the invention and together with the description serve to explain the principles of the invention.

DETAILED DESCRIPTION OF THE PREFERRED EMBODIMENTS

Figure 1A:
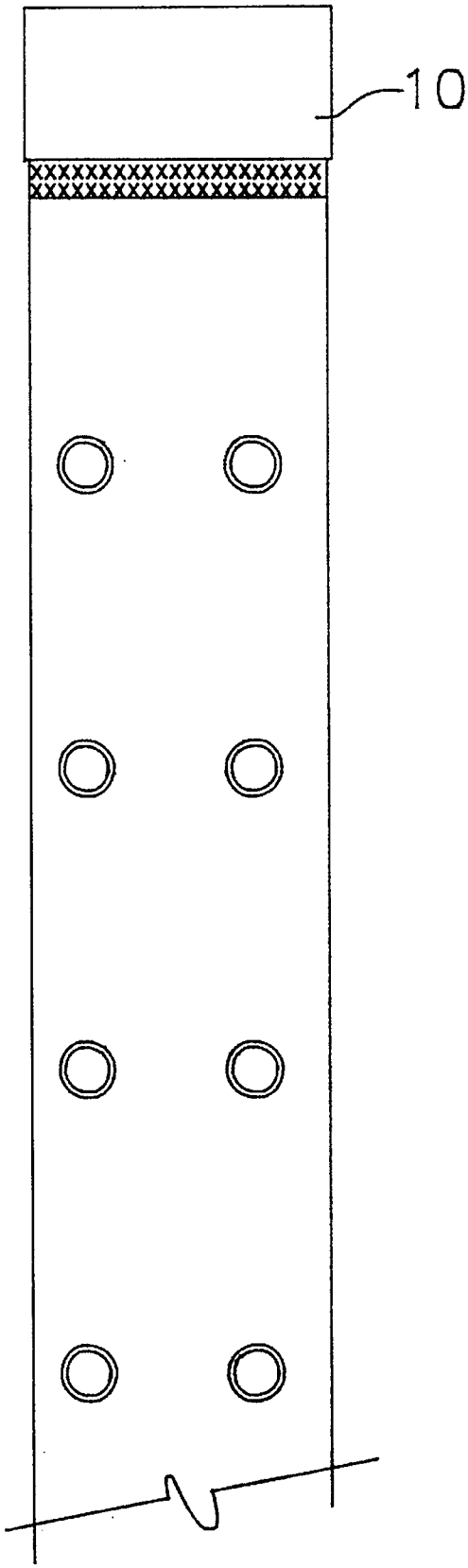
FIG. 1A. is s front view of the belt with cylinder attached and eyelets cut.
Figure 1B:
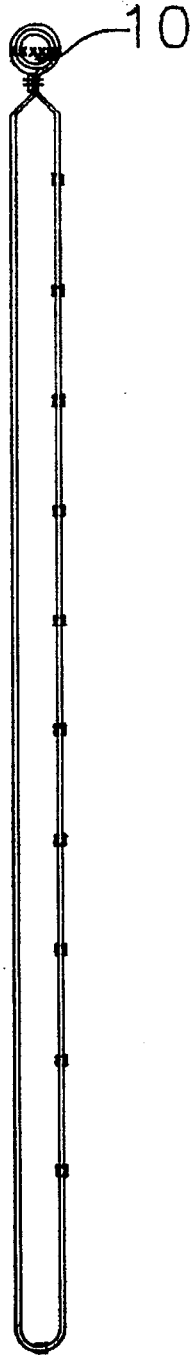
FIG. 1B. is a side view of the belt in its completed form.
Figure 1C:
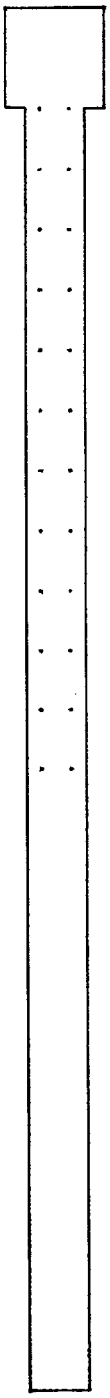
FIG. 1C. is a front view of the belt prior to attachment of the cylinder.
Figure 1D:
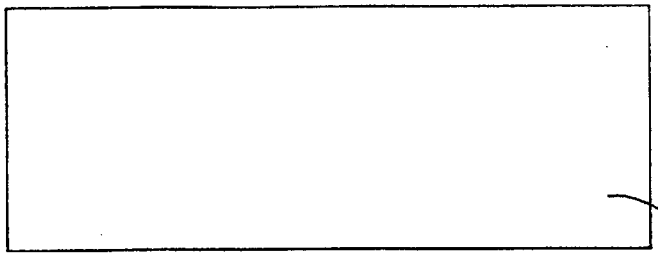
FIG. 1D. is a front view of the cylinder attached to the belt.
Figure 1E:
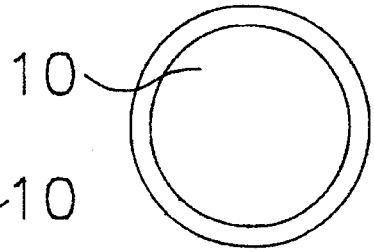
FIG. 1E. is a side view of FIG. 1D.

References will now be made in detail to the present embodiments of the invention, examples of which are illustrated in the accompanying drawings, wherein like reference numerals indicate like elements throughout the several views.

According to this invention a portable shoe and boot tie and cleaner apparatus for automotive vehicles is shown to include a flexible web belt FIG. 1A with a hard rubber cylinder 10. sewn into the top for securing the belt under the vehicle hood. The belt contains a plurality of paired, equally spaced openings or eyelets 11 providing an anchor point for securing the portable shoe and boot tie and cleaner apparatus FIG. 2B. to be hooked onto the belt FIG. 1A.

Figure 3A:
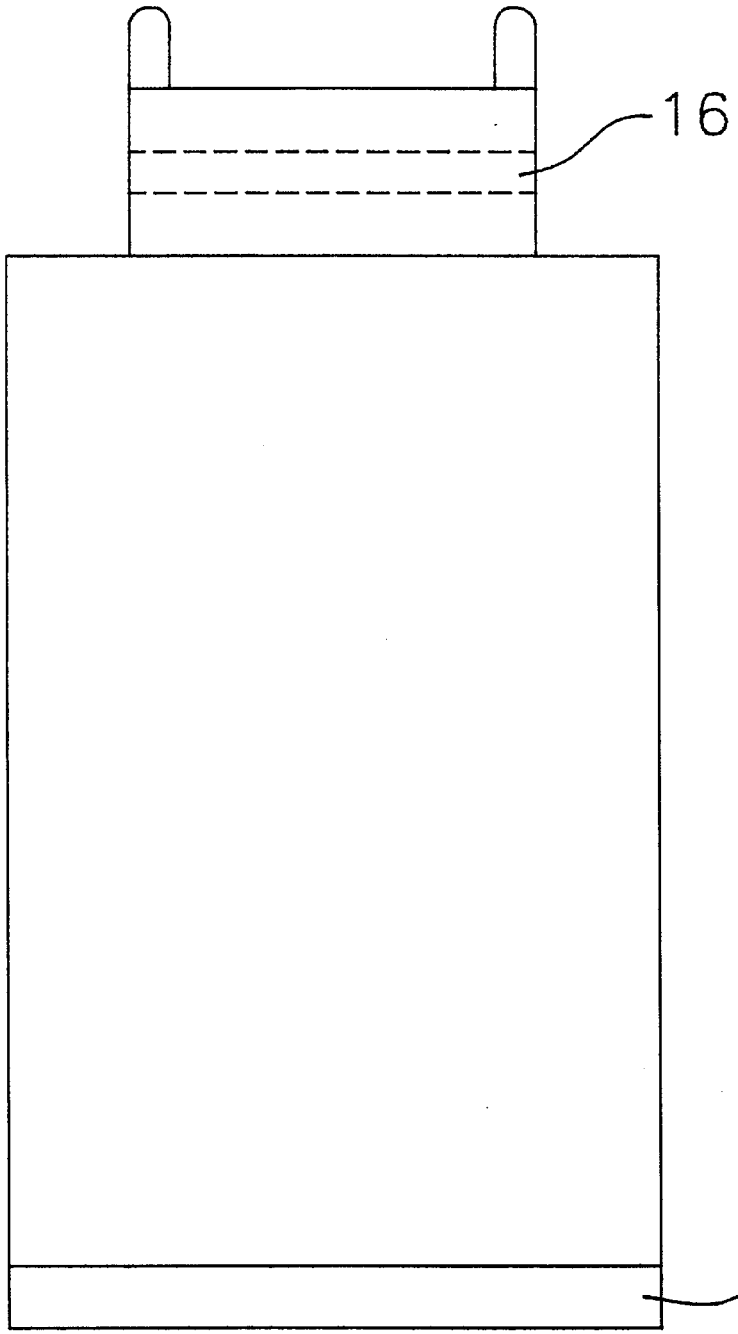
FIG. 3A. is a front view of the base.
Figure 3B:
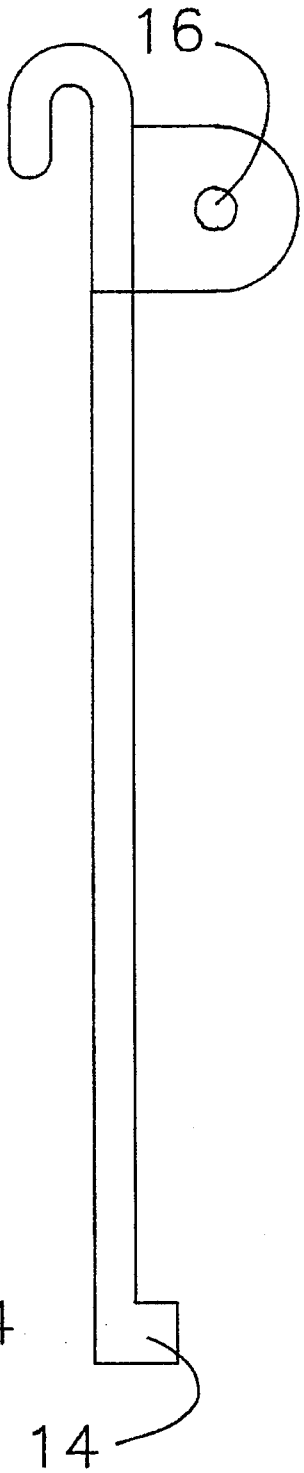
FIG. 3B. is a side view of the base.
Figure 4A:
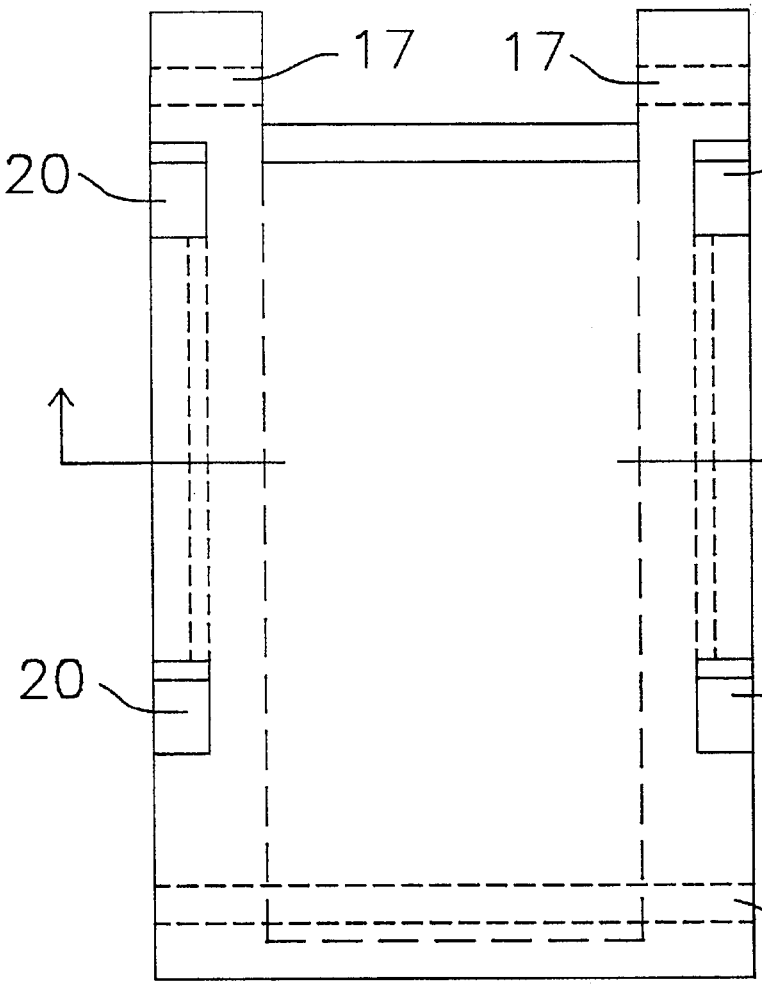
FIG. 4A. is a front view of the foot support.
Figure 5A:
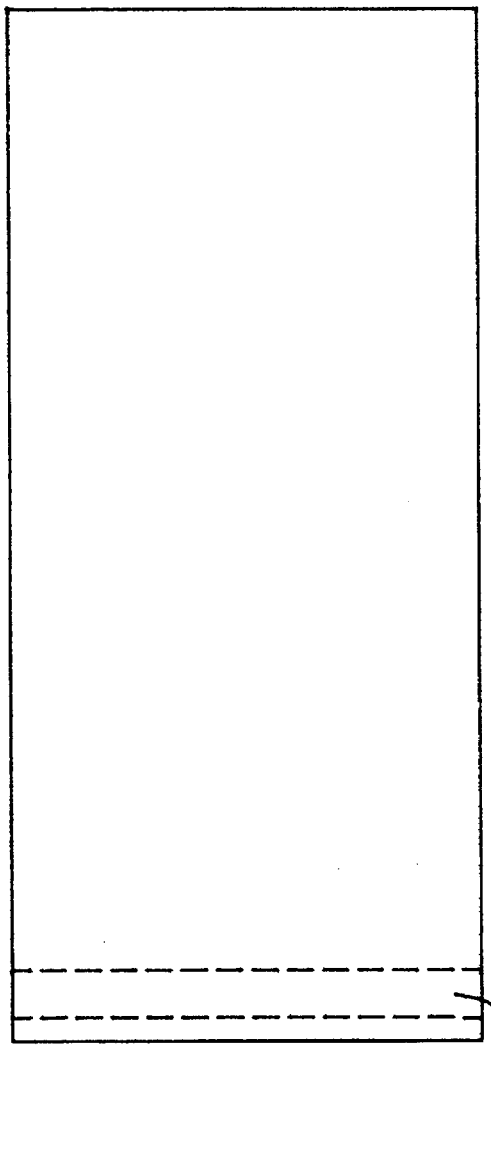
FIG. 5A. is a front view of the brace.

In use, the base FIG. 3B. is hooked to the secured belt FIG. 1A., the foot support FIG. 4A. pivots out 12 from the base 3A. the brace FIG. 5A. pivots down 13 from the foot support FIG. 4A. and locks the apparatus in place against the bottom lip protrusion 14 on the base FIG. 3A.

Figure 2A:
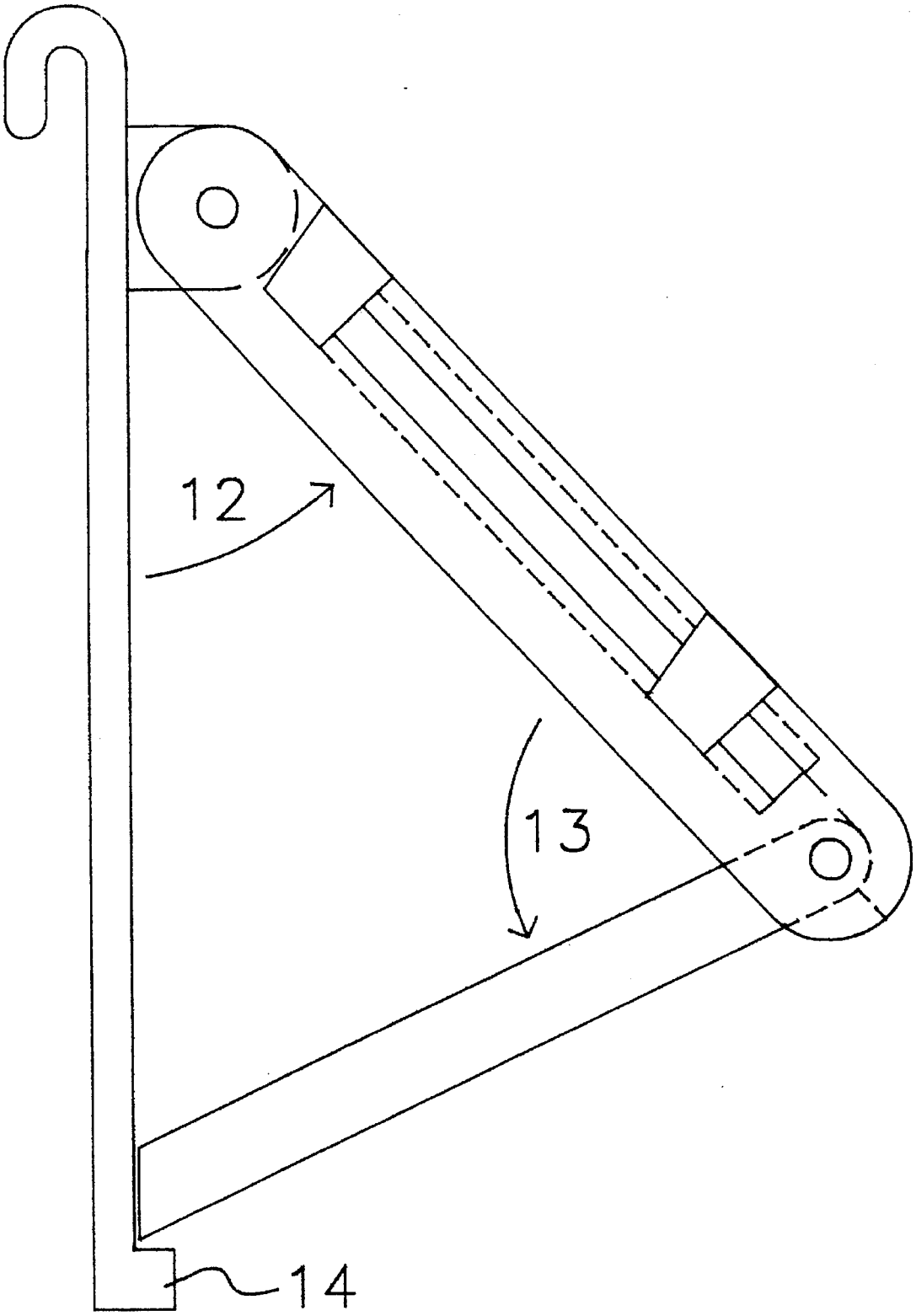
FIG. 2A. is a side view of the portable shoe and boot tie and cleaner apparatus for vehicles in its open, locked supporting position.
Figure 2B:
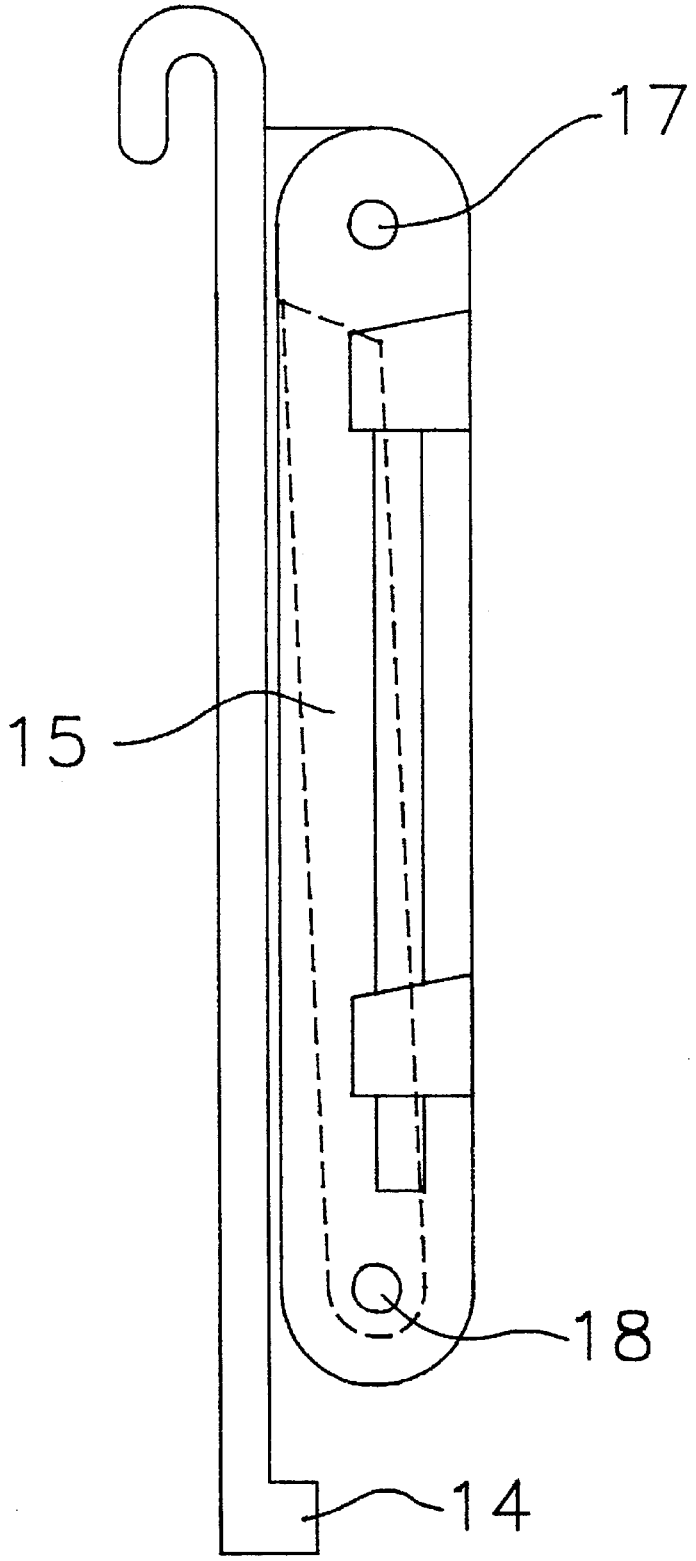
FIG. 2B. is a side view of the portable shoe and boot tie and cleaner apparatus for vehicles in its closed position.

When not in use FIG. 2B., the foot support FIG. 4A lies flat against the base FIG. 3A. with the brace FIG. 5A. rotated into 15 the underside of the foot support FIG. 4A.

Figure 4B:
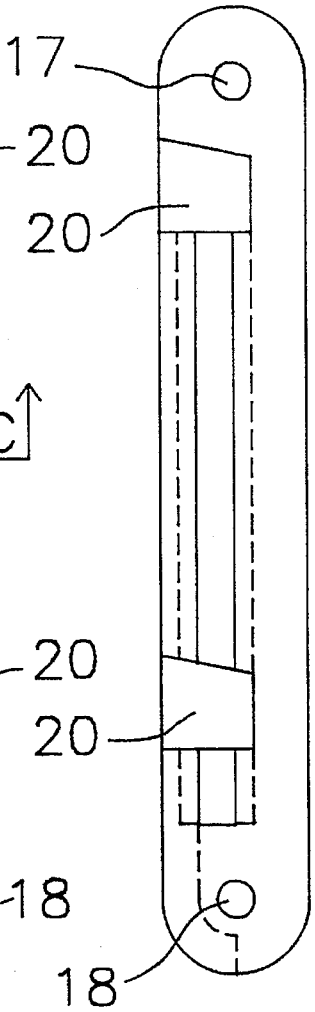
FIG. 4B. is a side view of the foot support.
Figure 5B:
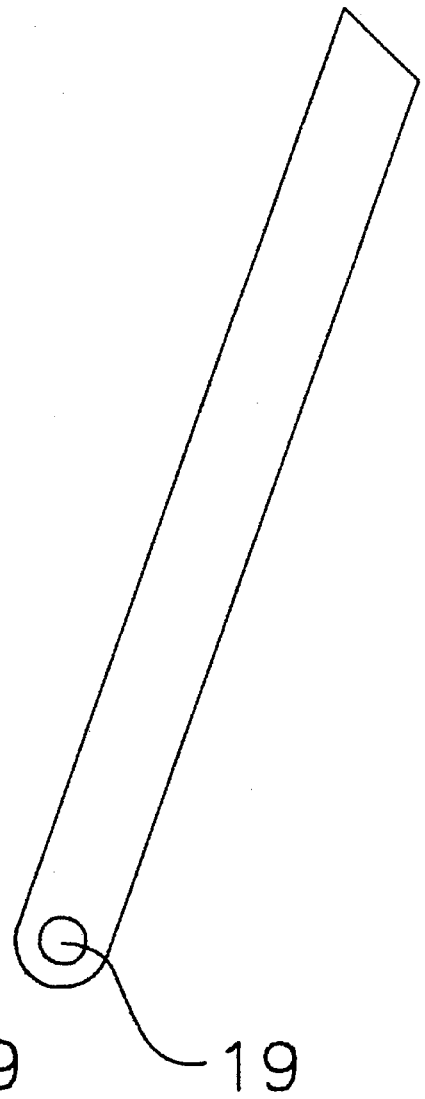
FIG. 5B. is a side view of the brace.

The base FIG. 3B. has an opening at the top 16 which aligns for connecting at the top 17 of the foot support FIG. 4B. The foot support FIG. 4B. also has a horizontal hole at the bottom 18 for connection with the opening 19 at the bottom of the brace FIG. 5B. These points are joined and pivotally held with a pin to allow the rotating action of the parts.

Figure 4C:
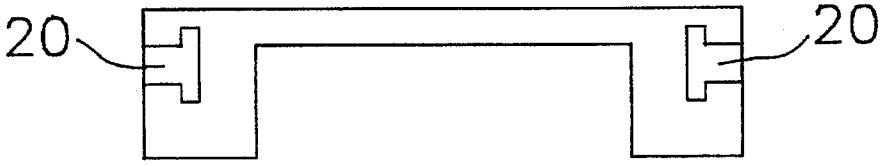
FIG. 4C. is a cutout view along line 4C in FIG. 4A of the interior of the foot support.
Figure 6A:
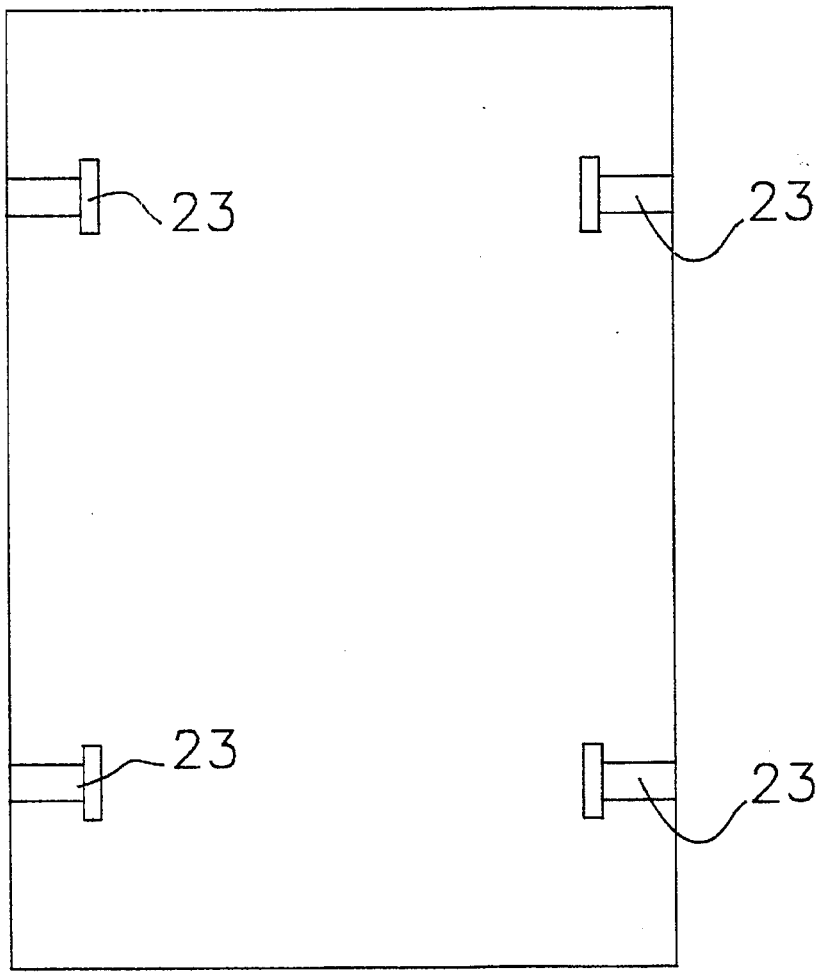
FIG. 6A. is an underside view of the attachment.
Figure 6B:
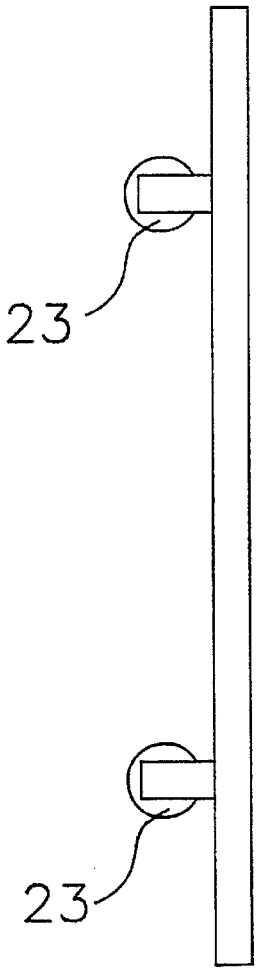
FIG. 6B. is a side view of the attachment.
Figure 6C:
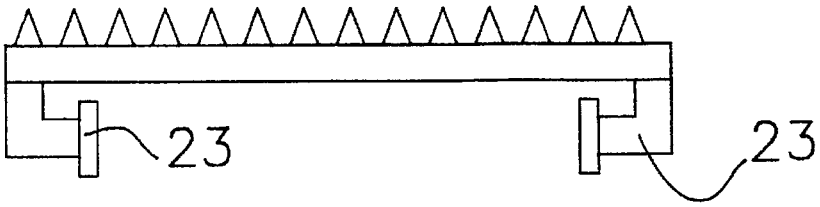
FIG. 6C. is a view from the bottom of the spiked attachment.
Figure 6D:
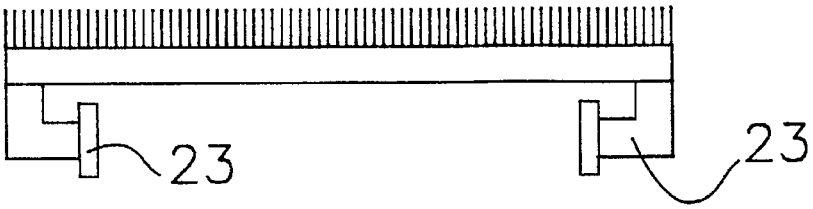
FIG. 6D. is a view from the bottom of the wire brush attachment.

The cut out portions 20 shown in foot support FIG. 4B from the side, FIG. 4A. from the top 20 and FIG. 4C. in cut-away 20 accept the the two attachments FIGS. 6C and 6D. The four protruding arms 23 shown in FIGS. 6A., 6B., 6C. and 6D. drop into the top of the foot support and slide down to lock the attachment in place.

It will be apparent to those skilled in the art that various modifications can be made to the portable shoe and boot tie and cleaner apparatus of the instant invention without departing from the scope or spirit of the invention, and it is intended that the present invention cover modifications and variations of the portable shoe and boot tie and cleaner apparatus provided they come in the scope of the appended claims and their equivalents.

I claim:

1. A portable footwear cleaning apparatus comprising, in combination:

(a) an elongated web belt having opposite first and second ends, a rigid cylinder fixed to the first end of the belt which is adapted to be secured to a vehicle, said belt further including a plurality of pairs of eyelets spaced at regular intervals along the length of the belt;

(b) a base having a pair of hooks at a top portion thereof which are adapted to be attached to a respective one of the pairs of eyelets of the belt whereby the height of the base may be varied by the user, said base further including a lip disposed at a bottom portion thereof;

(c) a support member including a first end portion pivotally coupled to the base adjacent the top portion thereof and a second end portion having a brace pivotally coupled there to which is adapted to engage the lip of the base, the support member further including slots disposed at opposite side portions thereof, the support member being adapted to be pivoted to a first cleaning position as well as a second storage position; and (d) a footwear cleaning attachment removably coupled to the support member, the cleaning attachment including cleaning means on a top surface thereof for cleaning the footwear and attachment means in the form of arms which are adapted to engage the slots of the support member whereby the cleaning attachment is slidably and removably connected to the support member.

2. The footwear cleaning apparatus as set forth in claim 1 wherein the cleaning means is a wire brush.

3. The footwear cleaning apparatus as set forth in claim 1, wherein the cleaning means is a plurality of metal cleats adapted to scrape the footwear.

* * * * *